US008800598B2

(12) United States Patent
Beyer et al.

(10) Patent No.: US 8,800,598 B2
(45) Date of Patent: Aug. 12, 2014

(54) DEVICE FOR CONVEYING FUEL

(75) Inventors: Martin Beyer, Marbach (DE); Eugen Martin, Bietigheim-Bissingen (DE); Hans-Peter Braun, Renfrizhausen (DE)

(73) Assignee: Robert Bosch GmbH, Stuttgart (DE)

( * ) Notice: Subject to any disclaimer, the term of this patent is extended or adjusted under 35 U.S.C. 154(b) by 75 days.

(21) Appl. No.: 13/498,508

(22) PCT Filed: Sep. 9, 2010

(86) PCT No.: PCT/EP2010/063232
§ 371 (c)(1),
(2), (4) Date: Mar. 27, 2012

(87) PCT Pub. No.: WO2011/051039
PCT Pub. Date: May 5, 2011

(65) Prior Publication Data

US 2012/0199223 A1 Aug. 9, 2012

(30) Foreign Application Priority Data

Oct. 28, 2009 (DE) ..... 10 2009 046 112

(51) Int. Cl.
*F04B 17/00* (2006.01)
*F02M 37/10* (2006.01)

(52) U.S. Cl.
CPC ..... *F02M 37/103* (2013.01)
USPC ..... 137/565.24; 417/363; 123/509

(58) Field of Classification Search
USPC ..... 137/565.24, 565.01, 581; 417/363; 123/508, 509
See application file for complete search history.

(56) References Cited

U.S. PATENT DOCUMENTS 2,674,405 A * 4/1954 Cawl ..... 417/363
3,065,941 A * 11/1962 Loftis ..... 248/604

(Continued)

FOREIGN PATENT DOCUMENTS

DE 4336574 5/1995

OTHER PUBLICATIONS

PCT/EP2010/063232 International Search Report.

*Primary Examiner* — John Rivell
*Assistant Examiner* — Umashankar Venkatesan
(74) *Attorney, Agent, or Firm* — Michael Best & Friedrich LLP

(57) ABSTRACT

Devices for conveying fuel are known having a conveying assembly and a pump holder holding the conveying assembly which has a receptacle for the conveying assembly and a holder connected to the receptacle via three damping elements. The damping elements damp the structure-born noise transmission from the conveying assembly to the adjacent components. The damping elements each have a cantilever section which projects starting from the receptacle into the region of the holder and runs in the radial direction and circumferential direction. The cantilever sections are designed as elastic spring arms, the axial deflection thereof in respect of a pump axis being able to exceed a maximum allowable value by means of external acceleration forces. The mechanical stresses occurring in the spring arms can lead to damage to the spring arms. In the device according to the invention, the damping elements have a strongly progressive spring characteristic curve in respect of an axial deflection such that a progressively increasing spring force in the damping element occurs with increasing spring travel of the pump holder. The axial deflection of the pump holder is consequently reduced over that of the prior art. According to the invention, an elastic spring section (15) connects on the cantilever section (12) which runs with the longitudinal extension thereof in the axial direction and in the circumferential direction in respect of a pump axis (2.1) and is connected to the holder (11).

10 Claims, 4 Drawing Sheets

(56) References Cited

U.S. PATENT DOCUMENTS

| | | | | |
|---|---|---|---|---|
| 3,643,981 | A * | 2/1972 | Grandel et al. | 280/775 |
| 4,212,600 | A * | 7/1980 | Otto et al. | 417/360 |
| 5,875,816 | A * | 3/1999 | Frank et al. | 137/549 |
| 6,216,734 | B1 * | 4/2001 | Umetsu et al. | 137/565.24 |
| 7,056,102 | B2 * | 6/2006 | Cremer et al. | 417/363 |
| 7,124,748 | B2 * | 10/2006 | Gaffield et al. | 123/509 |
| 7,191,767 | B2 * | 3/2007 | Schmitt | 123/509 |
| 7,771,177 | B2 * | 8/2010 | Maillard et al. | 417/423.15 |
| 7,909,587 | B2 | 3/2011 | Hagist et al. | |
| 8,136,509 | B2 * | 3/2012 | Wattai et al. | 123/509 |
| 8,427,020 | B2 * | 4/2013 | Hoffman et al. | 310/89 |
| 2003/0188723 | A1 | 10/2003 | Ichikawa et al. | |
| 2010/0119387 | A1 | 5/2010 | Malec et al. | |

* cited by examiner

DEVICE FOR CONVEYING FUEL

BACKGROUND OF THE INVENTION

A device for conveying fuel is already known from DE 43 36 574 A1, with a conveying assembly and with a pump holder which holds the conveying assembly and which has a receptacle for the conveying assembly and a holder connected to the receptacle via three damping elements. The damping elements damp the transmission of solid-borne sound from the conveying assembly to the adjacent components. The damping elements have in each case a projecting portion which projects from the receptacle into the region of the holder and at the same time runs in the radial direction and in the circumferential direction. The projecting portions are designed as elastic spring arms, of which the axial deflection with respect to a pump axis may overshoot a maximum permissible value due to external acceleration forces. The mechanical loads which in this case occur in the spring arms may cause the spring arms to be damaged.

SUMMARY OF THE INVENTION

The device according to the invention has by contrast the advantage that, in the event of axial deflection, the damping elements have a highly progressive spring characteristic curve, so that, with an increasing spring excursion of the pump holder, a progressively increasing spring force arises in the damping element. The axial deflection of the pump holder is thereby reduced, as compared with the prior art. This is achieved, according to the invention, in that the projecting portion has adjoining it an elastic spring portion which runs with its longitudinal extent in the axial direction and in the circumferential direction with respect to a pump axis and which is connected to the holder.

It is especially advantageous if the spring portion is designed in the form of a web, in the form of a flexural beam or in the form of a spring arm, since good decoupling of solid-borne sound is thereby achieved.

According to an advantageous refinement, the spring portion is of meander-shaped, U-shaped, V-shaped, W-shaped or S-shaped design.

It is highly advantageous if the W-shaped spring portion is connected at its two ends to the holder and at its middle bulge to the projecting portion, since, according to this first alternative, good acoustic decoupling is achieved.

It is advantageous, furthermore, if the spring portion is connected at one end to the holder and at the other end to the projecting portion, since, according to this alternative too, good acoustic decoupling is achieved.

It is advantageous, moreover, if the receptacle and the holder are arranged concentrically to one another, with a gap being provided between the receptacle and the holder. Oscillating relative movement of the receptacle with respect to the holder is thereby possible and is damped by the damping elements.

It is also advantageous if the receptacle projects beyond the holder in the axial direction with respect to a pump axis, since the damping elements can thereby be arranged near the circumference of the receptacle so as to save construction space. Moreover, in the event of radial stress directed toward the conveying assembly, the damping elements are supported on the receptacle.

Furthermore, it is advantageous if a shoulder is provided on the projecting portion of the receptacle or on the circumference of the receptacle and is movable axially between two stop edges of the holder, since the axial deflection of the receptacle is thereby limited in both directions, so that damage to the damping elements is effectively prevented.

BRIEF DESCRIPTION OF THE DRAWINGS

An exemplary embodiment of the invention is illustrated in simplified form in the drawing and is explained in more detail in the following description.

DETAILED DESCRIPTION

Figure 1:
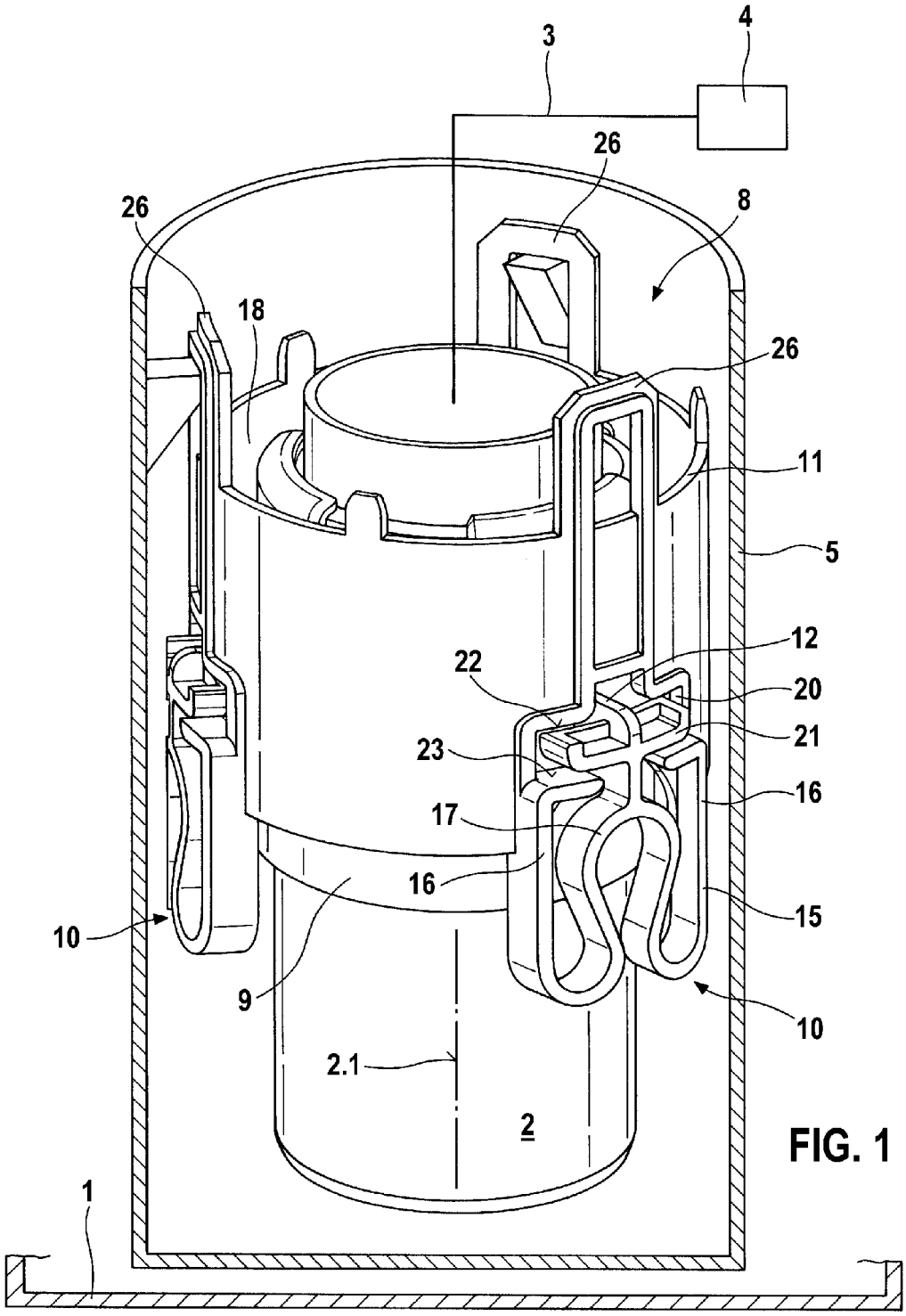
FIG. 1 shows a first exemplary embodiment of the device according to the invention.

FIG. 1 shows a first exemplary embodiment of the device according to the invention.

The device for conveying fuel is arranged in a fuel tank 1 and by means of a conveying assembly 2, for example an electric fuel pump, conveys fuel out of the fuel tank 1 at increased pressure via a delivery line 3 to an internal combustion engine 4. The conveying assembly 2 is arranged, for example, in a reservoir 5 which stores sufficient fuel for the conveying assembly 2, so that the latter can suck in fuel even when the filling levels in the fuel tank 1 are low and during acceleration, braking and driving on bends and/or hills.

The conveying assembly 2 is held by a pump holder 8 which comprises a receptacle 9 for the conveying assembly 2 and the holder 11 connected to the receptacle 9 via damping elements 10. The conveying assembly 2 is fastened in the receptacle 9 in the axial direction with respect to an axis 2.1 of the conveying assembly 2, for example by means of a press fit.

The damping elements 10 each have a projecting portion 12 which projects from the receptacle 9 into the region of the holder 11. The projecting portion 12 is, for example, web-shaped and is designed to be rigid in the axial direction. At least two, for example three or more damping elements 10 are provided, which are distributed over the circumference. The damping elements 10 allow an axial and radial oscillatory movement of the receptacle 9 together with the conveying assembly 2 arranged in it.

In order to prevent mechanical overstressing of the damping element 10 due to external acceleration forces, there is provision, according to the invention, whereby the projecting portion 12 of the damping element 10 has adjoining it an elastic spring portion 15 which runs with its longitudinal extent in the axial direction and in the circumferential direction with respect to the axis 2.1 and which is connected to the holder 11. The spring portion 15 runs near the circumference of the receptacle 9 or of the conveying assembly 2.

Damping elements 10 are thus achieved which, in the event of the axial deflection of the receptacle 9, have a highly progressive spring characteristic curve, so that soft springing first takes place, but, with an increasing spring excursion of the pump holder 8, a progressively increasing spring force arises in the damping element 10. The axial deflection of the pump holder 8 is thereby reduced, as compared with the prior art.

The spring portion 15 is designed in the form of a web, in the form of a flexural beam or in the form of a spring arm and runs, for example, in a meander-shaped, U-shaped, V-shaped, W-shaped or S-shaped manner.

In the first exemplary embodiment, the spring portion 15 is of W-shaped design, and it is connected at its two ends 16 to the holder 11 and at its central or middle bulge 17 to the projecting portion 12 of the receptacle 9. In the first exemplary embodiment, the bulge 17 is barreled and is thereby omega-shaped. The spring portion 15 according to the first exemplary embodiment is designed, for example, in such a way that, after an upward stroke of the receptacle 9, the mutually opposite legs of the bulge 17 move toward one another and finally butt one against the other at their narrowest point, with the result that the rigidity of the damping element 10 for a further upward stroke is increased and a progressively increasing spring force is achieved in a damping element 10. In the event of a downward stroke of the receptacle 9, for example, there is no progressively increasing spring force provided in the damping element 10, but this could of course be implemented.

Instead of the W-shape, an S-shape could also be provided, one end 16 being connected to the projecting portion 12 and the other end 16 to the holder 11.

For example, the receptacle 9, the damping element 10 and the damping element 10 with the projecting portion 12 and with the spring portion 15 are produced in an injection molding die by injection molding from plastic, with the result that the spring portion 15 is connected in one piece to the projecting portion 12 and to the holder 11.

The receptacle 9 and the holder 11 are arranged concentrically to one another, a gap 18 being provided between the receptacle 9 and the holder 11. The receptacle 9 and the holder 11 are, for example, of ring-shaped design, and the receptacle 9 can project beyond the holder 11 in the axial direction with respect to the axis 2.1.

In the first exemplary embodiment, the axial deflection of the receptacle 9 is limited in both axial directions. For this purpose, the projecting portion 12 projects into a recess 20 of the holder 11, the projecting portion 12 having formed on it a shoulder 21 which cooperates with the recess 20 and which is movable in the axial direction between two stop edges 22, 23 of the recess 20. The shoulder 21 is provided, for example, on both sides on the projecting portion 12, so that a T-shape or cross shape of the projecting portion 12 is formed. However, the stop edges 22, 23 may also be implemented in a way other than by the recess 20 on the holder 11.

The pump holder 8 is fastened, for example, by holding means 26 to the reservoir 5, but may of course also be fastened at other locations in the fuel tank 1.

Figure 2:
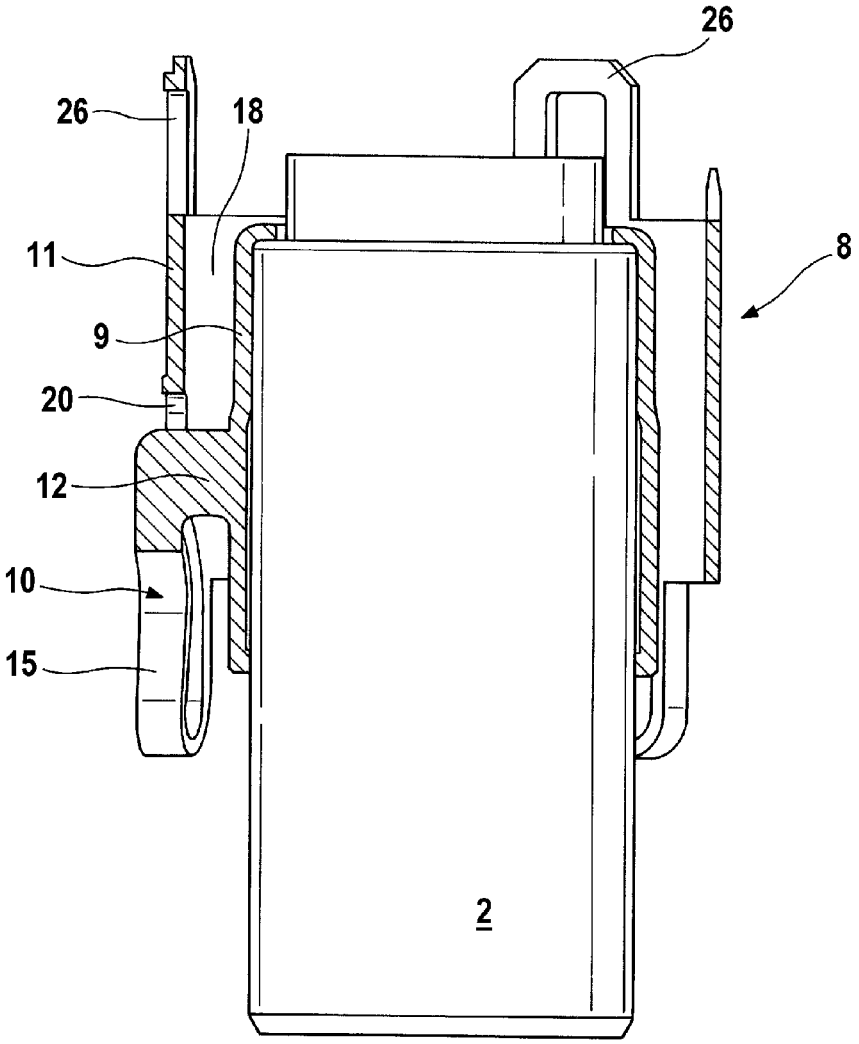
FIG. 2 shows a sectional view of the device according to FIG. 1.

FIG. 2 shows a sectional view of the device according to FIG. 1.

In the device according to FIG. 2, the parts equivalent to or acting identically to the device according to FIG. 1 are identified by the same reference symbols.

Figure 3:
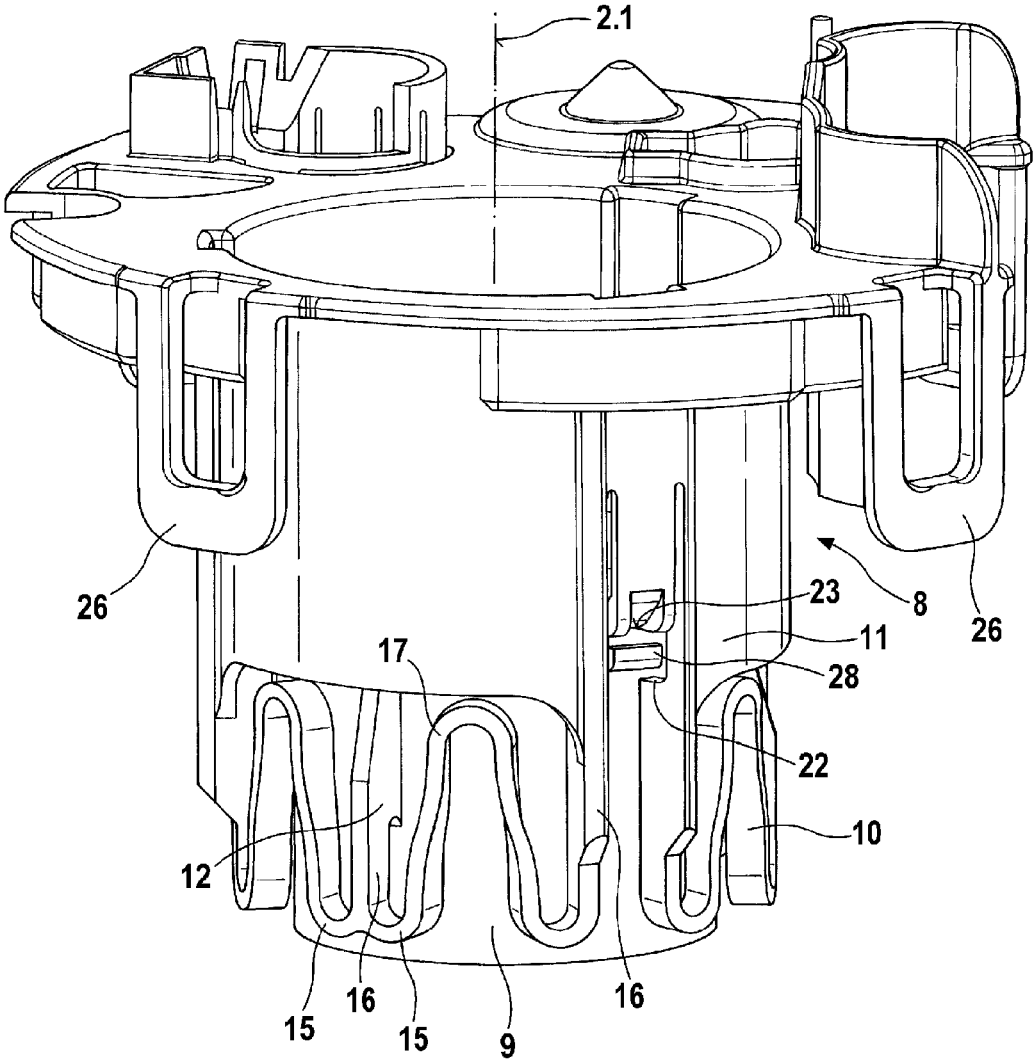
FIG. 3 shows a second exemplary embodiment of the device according to the invention.

FIG. 3 shows a second exemplary embodiment of the device according to the invention.

In the device according to FIG. 3, the parts equivalent to or acting identically to the device according to FIG. 1 and FIG. 2 are identified by the same reference symbols.

The second exemplary embodiment differs from the first exemplary embodiment in that the spring portion 15 is not connected at its one end 16 to the holder 11, but instead to the projecting portion 12 of the receptacle 9. The other end 16 is connected to the holder 11 as in the first exemplary embodiment. As in the first exemplary embodiment, the spring portion 15 is of W-shaped design. However, the middle or central bulge 17 differs from the first exemplary embodiment in that it is not coupled directly to the projecting portion 12, but instead is freely movable as a result of elastic flexion and tapers upwardly, that is to say toward the closed side.

Moreover, two damping elements 10 run to the holder 11 from each projecting portion 12, with the spring portions 15 of the two damping elements 10 running in the opposite circumferential direction. In this version, there is no progressively increasing spring force provided in the damping element 10, as is achieved in the first exemplary embodiment by legs abutting one against the other.

The holder 11 is, for example, part of a cover which is fastened to the reservoir 5.

Figure 4:
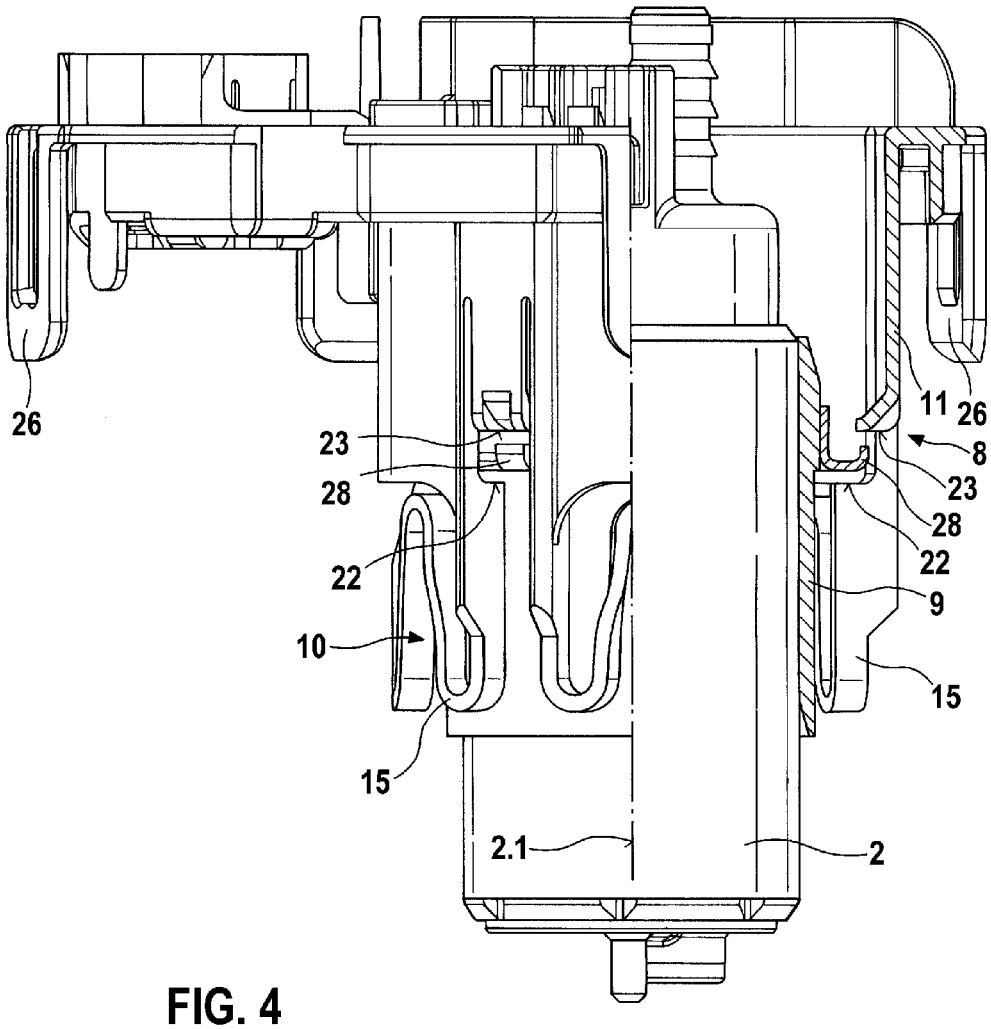
FIG. 4 shows a partial sectional view of the device according to FIG. 3.

FIG. 4 shows a partial sectional view of the device according to FIG. 3.

In the device according to FIG. 4, the parts equivalent to or acting identically to the device according to FIG. 1 to FIG. 3 are identified by the same reference symbols.

In the second exemplary embodiment, the axial deflection of the receptacle 9 is also limited in both axial directions. In contrast to the first exemplary embodiment, the shoulder 21 is not provided on the projecting portion 12 of the receptacle 9, but instead on the circumference of the receptacle 9, and cooperates with two stop edges 22, 23 of the holder 11. The shoulder 21 is formed, for example, by a ring 28 which is arranged on the receptacle 9 and which may be provided as a separate part or in one piece on the receptacle 9. Instead of a ring 28, a plurality of individual shoulders 21 may also be formed. The ring 28 may, for example as a metal ring, also have the function of fixing the conveying assembly 2 in the receptacle 9 by a press fit.

The invention claimed is:

1. A device for conveying fuel, the device comprising: a conveying assembly (2) and a pump holder (8) which holds the conveying assembly (2) and which has a receptacle (9) for the conveying assembly (2) and a holder (11) connected to the receptacle (9) via at least one damping element (10), the damping element (10) having a projecting portion (12) which projects from the receptacle (9) into the region of the holder (11), characterized in that the projecting portion (12) has adjoining it an elastic spring portion (15) connected to the holder (11), the spring portion (15) having arm portions that extend in an axial direction and at least one bend connecting adjacent arm portions, the bend formed about an axis that is generally perpendicular to a pump axis (2.1).

2. The device as claimed in claim 1, characterized in that the spring portion (15) is designed in the form of a web, in the form of a flexural beam or in the form of a spring arm.

3. The device as claimed in claim 1, characterized in that the spring portion (15) is of meander-shaped, U-shaped, V-shaped, W-shaped or S-shaped design.

4. The device as claimed in claim 1, characterized in that the spring portion (15) is W-shaped and is connected at two ends (16) to the holder (11) and at a central or middle bulge (17) to the projecting portion (12).

5. The device as claimed in claim 1, characterized in that the spring portion (15) is connected at one end (16) to the holder (11) and at another end (16) to the projecting portion (12).

6. The device as claimed in claim 1, characterized in that the receptacle (9) and the holder (11) are arranged concentrically to one another, with a gap (18) being provided between the receptacle (9) and the holder (11).

7. The device as claimed in claim 1, characterized in that the receptacle (9) projects beyond the holder (11) in the axial direction with respect to the pump axis (2.1).

8. The device as claimed in claim 1, characterized in that a shoulder (21) is provided on the projecting portion (12) of the receptacle (9) and is movable axially between two stop edges (22, 23) of the holder (11).

9. The device as claimed in claim 1, characterized in that a shoulder (21) is provided on the receptacle (9) and is movable axially between two stop edges (22, 23) of the holder (11).

10. The device as claimed in claim 9, characterized in that the shoulder (21) is formed by a ring (28) which is arranged on the receptacle (9).

* * * * *